US006945425B1

(12) United States Patent
Kim

(10) Patent No.: US 6,945,425 B1
(45) Date of Patent: Sep. 20, 2005

(54) INTERNAL TO EXTERNAL SELF-BOUYANT STRAW SYSTEM

(76) Inventor: Sung Suk Kim, 12280 SW. Scholls Ferry Rd., Tigard, OR (US) 97223

( * ) Notice: Subject to any disclaimer, the term of this patent is extended or adjusted under 35 U.S.C. 154(b) by 0 days.

(21) Appl. No.: 10/431,201

(22) Filed: May 7, 2003

Related U.S. Application Data

(63) Continuation-in-part of application No. 09/753,960, filed on Jan. 4, 2001, now abandoned.

(51) Int. Cl.[7] ..... A47G 21/18
(52) U.S. Cl. ..... 220/706; 215/389
(58) Field of Search ..... 220/706, 709, 220/710, 906; 215/389

(56) References Cited

U.S. PATENT DOCUMENTS 4,877,148 A * 10/1989 Larson et al. ..... 220/706
5,080,247 A * 1/1992 Murphy et al. ..... 220/706
5,431,297 A * 7/1995 Rosello ..... 220/706
6,056,149 A * 5/2000 Murphy et al. ..... 220/705

* cited by examiner

*Primary Examiner*—Joseph C. Merek

(74) *Attorney, Agent, or Firm*—Michael I Kroll

(57) ABSTRACT

An internal to external self-buoyant straw system for the safe and sanitary removal of contents from aluminum can lift tab containers. The system includes a top straw component (14) cylindrical and hollow in fabrication which vertically slides within close tolerance over its hollow bottom straw component (16) whose lower end is angular cut (30) and held in continuous contact with the container's inner bottom. The top straw component continues its vertical ascent until its integrally fabricated buoyancy float (15) makes contact with the guidance ring (13) which keeps the top straw component directly positioned inline with the container's lid opening. The upper straw component (23) having reached drinking access level may now be angularly adjusted at the outer segmented straw portion (22) for ease of consumption of contents through the rolled lip end (28). Stability and appropriate positioning of the internal to external self-buoyant straw system within its container is accomplished by means of an articulated structure: holding frame (19) and holding frame arm (29) anchored to the underside of the container's lid at points (24A) and (24B) with the holding frame's lowermost end connected at point (18) to the bottom straw component, thusly causing the bottom straw component to remain stationary and in continuous contact with the container's innermost bottom. The all aluminum fabrication of the internal to external self-buoyant straw system allows for recycling within the aluminum can lift tab beverage container.

5 Claims, 7 Drawing Sheets

INTERNAL TO EXTERNAL SELF-BOUYANT STRAW SYSTEM

RELATED APPLICATION

This is a continuation-in-part of Ser. No. 09/753,960, filed 4 Jan. 2001, now abandoned.

BACKGROUND OF THE INVENTION

1. Field of the Invention

This invention relates to a device for the safe and sanitary removal of the contents from aluminum can lift tab beverage containers allowing for an all aluminum internal to external self-buoyant straw system contained therein.

2. Description of the Prior Art

Several styles of containers with a straw system of one sort or another have been presented in prior art. By one means or another the straw systems presented in prior art are said to raise to drinking access level when their respective container is opened for consumption. While these straw systems presented in prior art may operate in their proscribed manner they display shortcomings in design or adaptability for their intended use. U.S. Pat. No. 4,109,817 to Payne et al (1978), depicts a straw system for use with a pull tab container that is generally no longer in use within the beverage industry. Prior art in U.S. Pat. No. 4,877,148 to Larson et al (1989), U.S. Pat. No. 5,080,247 to Murphy et al (1992), U.S. Pat. No. 5,431,297 to Rosello (1995) and U.S. Pat. No. 5,819,979 to Murphy et al (1998) collectively and severally depict a straw system that raises away from the inner bottom of its container when said container is opened for consumption, thereby requiring the consumer to further manipulate the straw to facilitate the removal of the container's contents through said straw. U.S. Pat. No. 4,877,148 to Larson et al (1989) depicts a straw system that requires an additional depression of the straw's container to release said straw, with possible spillage or over-depression occurring, as well as the requirement of additional instructions to the consumer. U.S. Pat. No. 5,819,979 to Murphy et al (1998) in prior art depicts a straw system that requires a new style of lid for the container to enable the proposed straw system to function. U.S. Pat. No. 4,109,819 to Payne et al (1978), U.S. Pat. No. 5,080,247 to Murphy et al (1992), U.S. Pat. No. 5,819,979 to Murphy et al (1998) collectively and severally depict in prior art an internal straw system with an activating mechanism for placement within the straw system's container of an intricate nature with numerous parts, thereby requiring considerable pre-assembly and/or space within the said container.

U.S. Pat. No. 5,431,297

Inventor: Agustin A. Rosello

Issued: Jul. 11, 1995

A pop-up straw device for containers such as cans and bottles having necks narrower than the body of the bottle. When the device is employed in a can, a vertical guide assembly aligns a telescoping straw assembly with a beverage container's mouth. The telescoping straw assembly includes interior and exterior straws. The interior straw extends out of the mouth of the beverage container once the container is opened. A floater, having a density less than that of the liquid in the container, urges the telescoping straw assembly to protrude out of the container's mouth. In an alternative embodiment, a bracket assembly is mounted to the interior top of the can and aligns the telescoping straw assembly with the mouth of the can. When the device is utilized in a bottle only the floater and the telescoping straw assemblies are required. The walls of the body and neck of the bottle, in conjunction with the floater align the telescoping straw assembly with the mouth of the bottle and the floater is of sufficient rigidity such that it cannot be easily pulled through the mouth of the bottle and thereby prevents the telescoping straw assembly from being pulled completely out of the bottle while at the same time permitting a user to extend the telescoping straw assembly partially out of the bottle.

U.S. Pat. No. 4,109,817

Inventor: Larry E. Payne et al

Issued: Aug. 29, 1978

A straw assembly for a liquid container having a pull-tab closure over an opening in its top. Removal of the closure allows the straw which is collapsed within the container and has a float mounted on its bottom end, to rise through the opening where it is manually extended to its full length. One embodiment includes the straw being slidably journaled within a tube mounted on the inner wall of the container. Another embodiment includes a straw guide assembly which positions the straw within the container in registry with an opening centrally disposed through the container top.

U.S. Pat. No. 4,877,148

Inventor: Gordon Larson

Issued: Oct. 31, 1989

A straw assembly is provided for a liquid container having a push tab or pull tab closure in a metallic container or a screw type closure on a plastic container. The straw is retained within the container in a retracted position even following opening of the removable closure. The straw is moved to an operative position by depressing a portion of the container so as to shift the straw laterally and permit the straw to emerge through the dispensing opening by means of a buoyancy collar on the straw.

U.S. Pat. No. 5,080,247

Inventor: Peter F. Murphy

Issued: Jan. 14, 1992

The present invention is a device for a container. The container includes a tubular body having a closed end, an open end and a longitudinal axis. A lid is secured to the open end and having an orifice. A closure tab is pivotally connected to the lid and temporarily closes the orifice. An actuating member is pivotally secured to the lid and is being manually actuated for moving the closure tab into the interior of the body to open the orifice in the lid. The device includes a conduit disposed within the body. A means is disposed within the body and adapted to engage the body for supporting the conduit substantially parallel to the longitudinal axis of the body. Another means forms a float for elevating the conduit through the orifice in the lid when liquid is present within the body and the tab is deflected into the interior of the body to open the orifice. The device may include means for rotating the conduit to align the conduit with the orifice of the lid.

U.S. Pat. No. 5,819,979

Inventor: Peter F. Murphy

Issued: Oct. 13, 1998

A beverage container has a straw-dispensing mechanism that is disposed within the container to bring the straw into alignment with the orifice in the top of the container. When the orifice is opened, the straw elevates through the orifice to become accessible to the user. In one embodiment, the straw is attached to a buoyant member which urges the straw into contact with a contoured surface on the can lid. The contoured surface is angled towards the orifice. In a second embodiment, the straw engages a floating member which is urged against the lid of the container. When the container is opened by deflecting a closure tab into the container, the closure tab engages a cam surface on the floating member and imparts rotational motion to the floating member. The floating member rotates until the straw is aligned with the open orifice and a buoyant member associate with on the straw elevates the straw through the orifice.

SUMMARY OF THE INVENTION

The primary object of the present invention is to provide an internal to external self-buoyant straw system for aluminum can lift tab beverage containers of an improved nature as well as enhanced safety features and complete recycle ability within said container.

The present invention is designed wholly and in part for use within the aluminum can lift tab containers presently found in general use in the beverage industry.

When said lift tab aluminum can beverage container is opened for consumption the self-buoyant straw with rise to the appropriate safe drinking access level which is predetermined in the design of said straw system.

When said self-buoyant straw has risen to the desired drinking access level the outer segmented portion so designed to provide greater flexibility and limited extension of the straw is exposed thereby allowing angular manipulation of said straw to facilitate easier consumer consumption and use.

When said self-buoyant straw system's top component has risen to drinking access level, the bottom straw component is retained in angular contact with the container's inner bottom, thereby allowing for complete removal of the contents within said beverage container without further manipulation of the straw or the tipping of said container.

The consumer shall be able to drink from the self-buoyant straw in lieu of placing their mouth directly in contact with the outside of the container thereby providing a more safe and sanitary means of consuming the contents from their containers.

Still further by use of the self-buoyant straw system a beverage may be consumed by those that may be unable to tilt or lift and tilt a container for one reason or another.

The design and construction of the internal to external straw system prevents accidental discharge or removal of the said straw from its container thereby enhancing safety issues.

The design and construction of the internal to external self-buoyant straw system prevents over extension of said straw thereby further enhancing safety issues.

The all aluminum construction material of the internal to external self-buoyant straw system is completely compatible with aluminum can lift tab beverage containers, being fabricated of like material, therefore the straw system is completely recyclable within its container.

The structural design of the internal to external self-buoyant straw system is stable in itself. However stability is further enhanced by the anchoring at two points to the bottom straw component, thereby remaining positionally parallel to the inner walls of the container and in direct alignment with the lid access opening, as well as in continuous contact with the container's inner bottom.

When using the present invention it is not necessary to alter the present design or construction method in making the aluminum can lift tab beverage containers, rather the present invention is an adjunct and an improvement thereto.

The present invention will not interfere with the current manufacturing techniques for cold rolled or iron sheet processing used in the making of aluminum can lift tab containers.

An all aluminum self-buoyant straw system does not interfere with the current six-stage low temperature acid cleaning and sanitizing process used to clean and sanitize, nor the removal of residues, as well as aluminum fines from said containers.

Further objects and advantages of the internal to external self-buoyant straw system will become apparent as the description proceeds.

To the accomplishment of the above and related, this invention may be embodied in the form illustrated in the accompanying drawings with attention being called to the fact that the drawings are illustrative only, and that changes may be made in the specific construction illustrated and described within the scope of the appended claims.

In accordance with the presented art and appended claims the present invention is an all aluminum self-buoyant straw system, a safe and sanitary device for the methodical removal of the contents from aluminum can lift beverage containers.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

REFERENCE NUMERALS IN DRAWINGS

Figure 1:
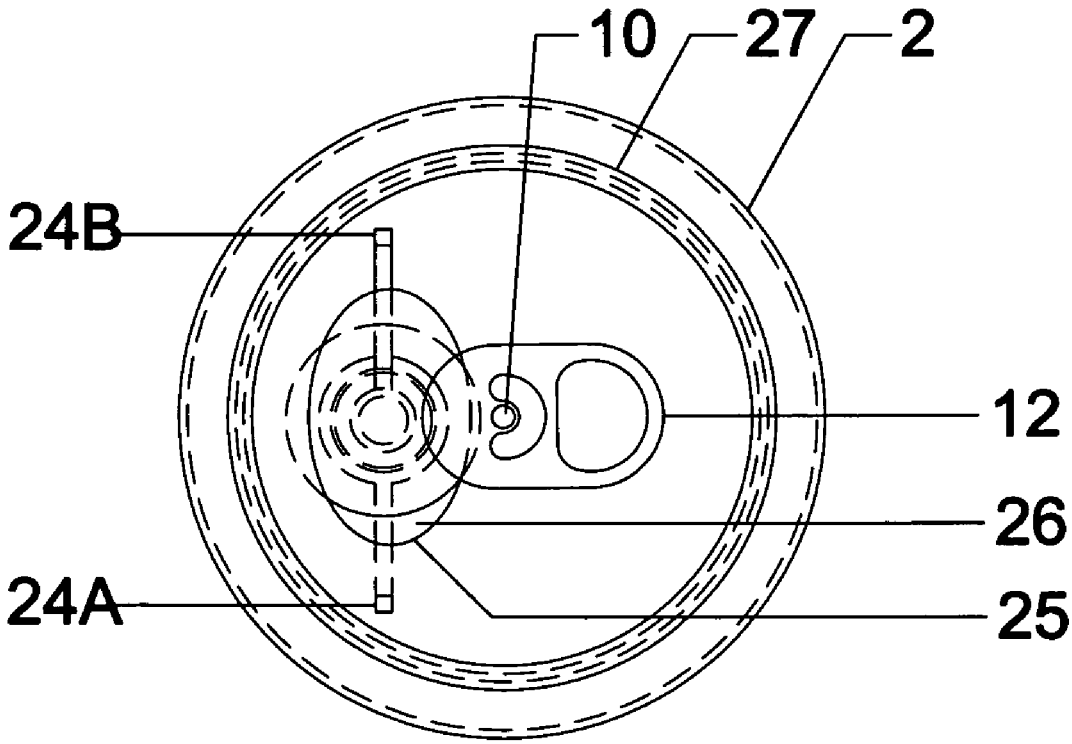
FIG. 1 is a top view of the aluminum can beverage container showing where the internal to external self-buoyant straw system is anchored to the container's lid with appropriate adhesive at points 24A and 24B.
Figure 2:
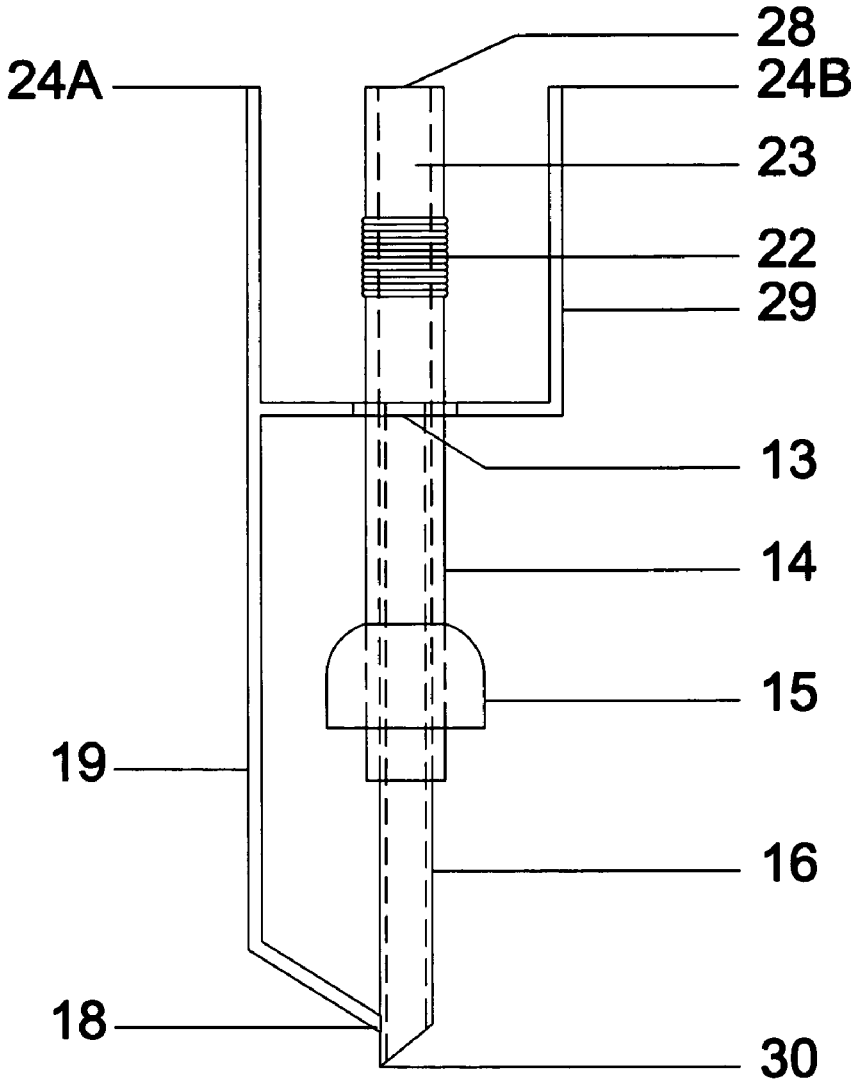
FIG. 2 is a side view of the internal to external self-buoyant straw system separate and apart from the aluminum can lift tab beverage container.
Figure 3:
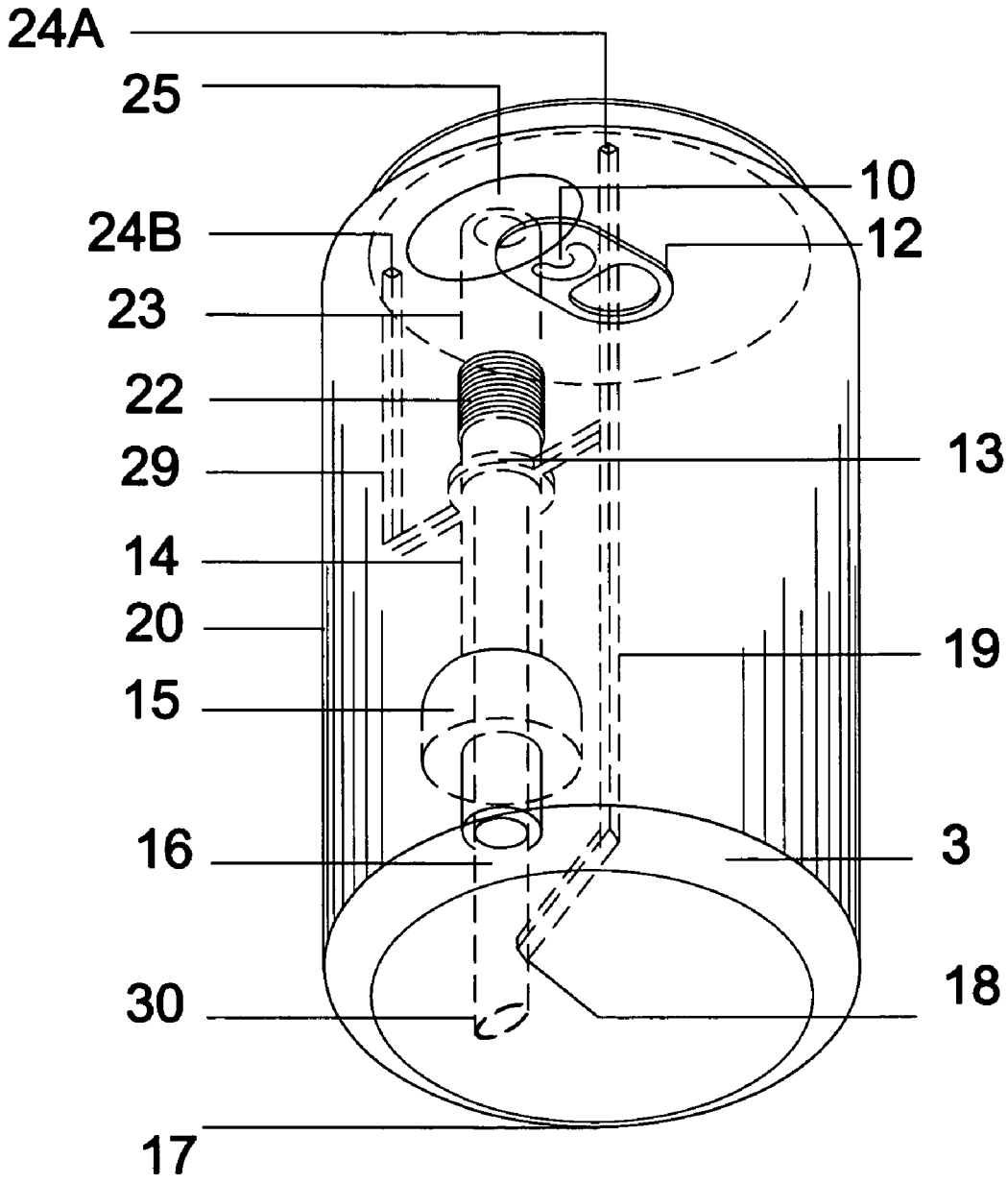
FIG. 3 is a perspective view of the internal to external self-buoyant straw system shown at a slight angle depicting the said system installed within an aluminum can lift tab beverage container.
Figure 4:
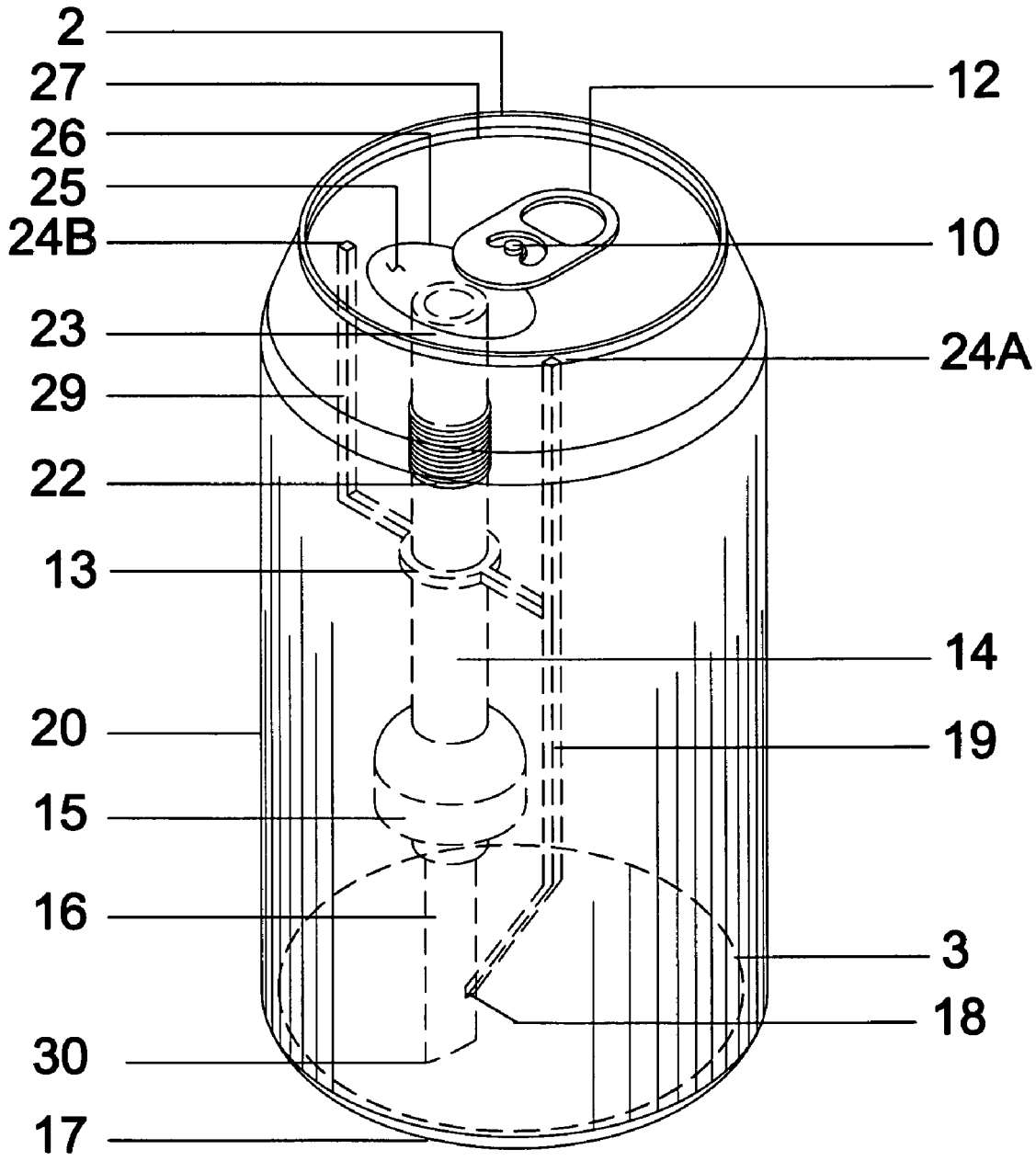
FIG. 4 is a perspective view at an opposing angle to FIG. 3, showing the internal to external self-buoyant straw system installed within an aluminum can lift tab beverage container.
Figure 5:
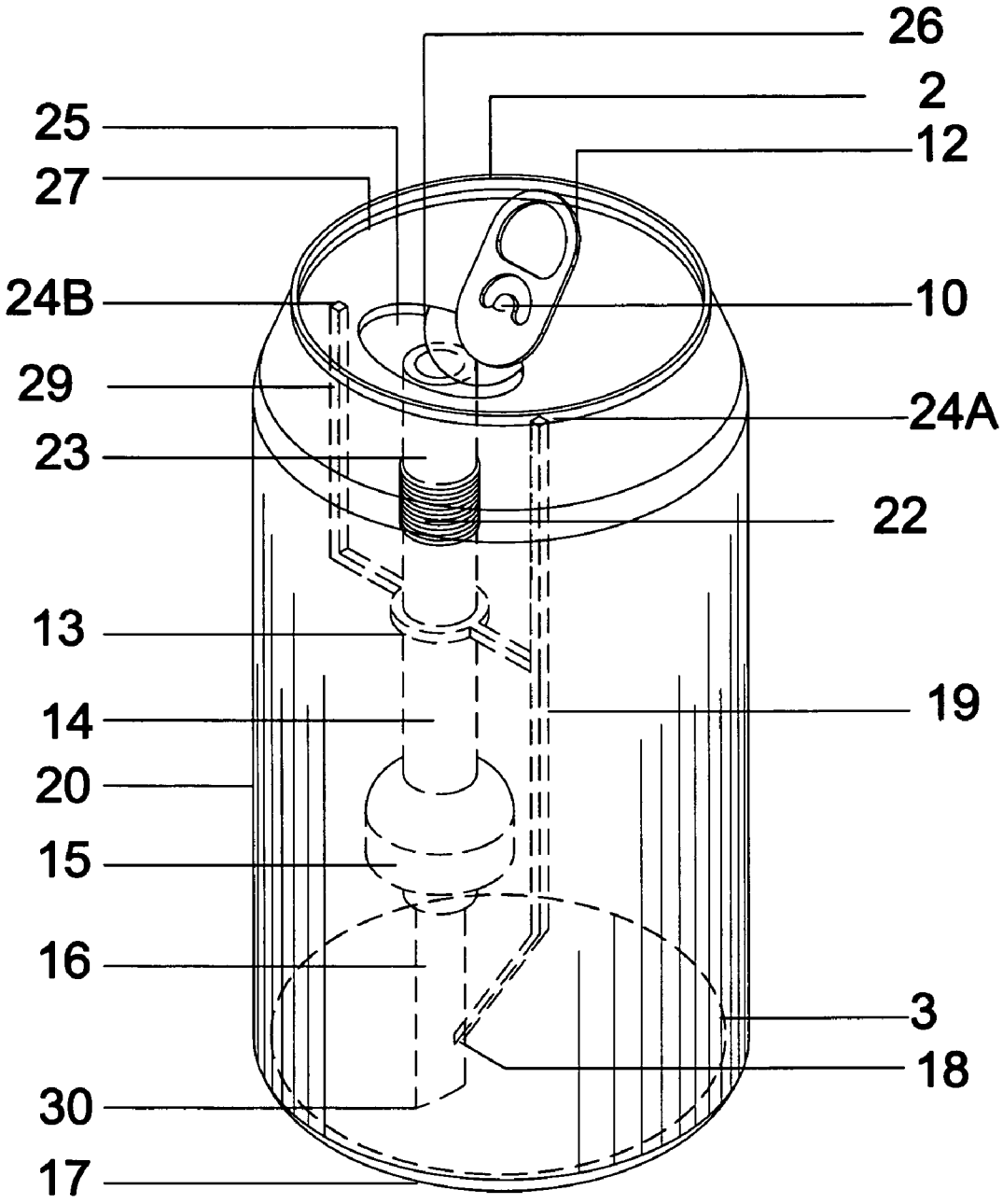
FIG. 5 is a top perspective view showing an aluminum can lift tab beverage container being opened by the lift tab, before the internal to external self-buoyant straw system has risen through the lid opening to drinking access level.
Figure 6:
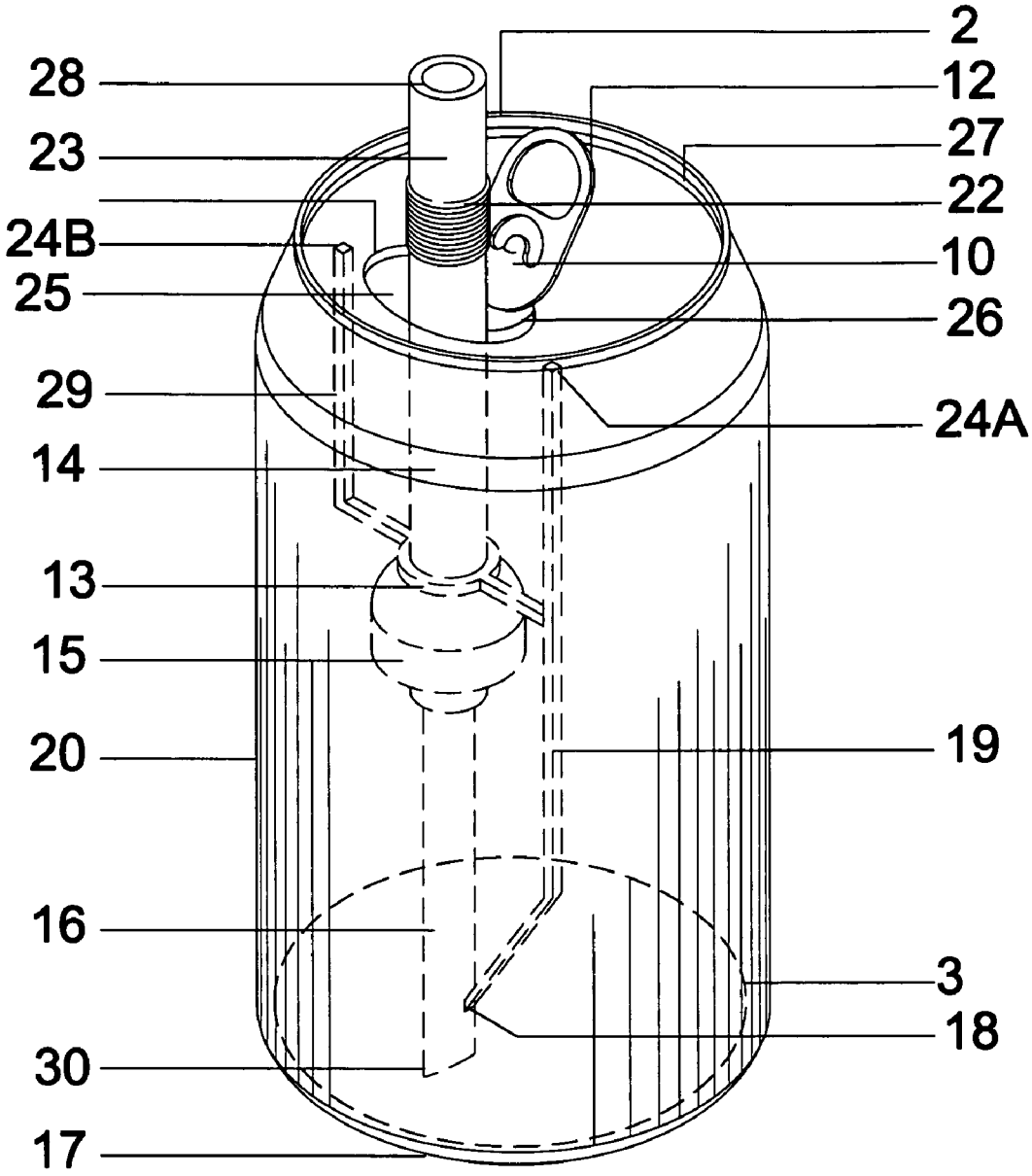
FIG. 6 is a top perspective view showing an aluminum can lift tab beverage container opened with the internal to external self-buoyant straw system having risen through the lid opening to drinking access level.
Figure 7:
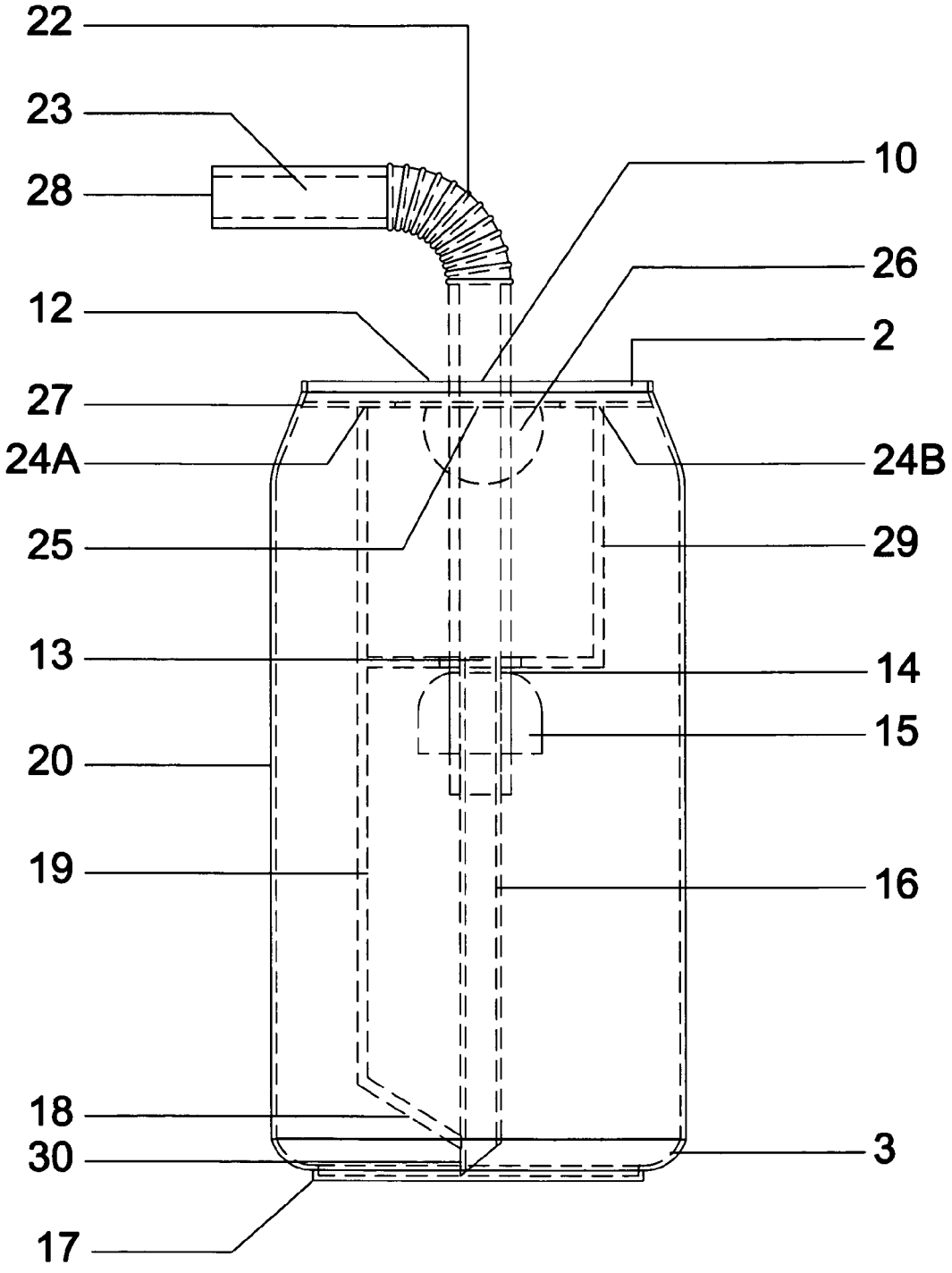
FIG. 7 is a top perspective view showing the internal to external self-buoyant straw system having risen through the lid opening to drinking access level with the adjustable outer segmented portion of the straw set at an acceptable drinking angle.

Turning now descriptively to the drawings, in which similar reference characters denote similar elements throughout the several views, the Figures illustrate the Internal to External Self-Buoyant Straw System of the present invention. With regard to the reference numerals used, the following numbering is used throughout the various drawing figures.

2 Top rim edge
3 Bottom rim edge
10 Lift tab rivet
12 Lift tab
13 Straw guidance ring
14 Top component of straw
15 Integral buoyancy float
16 Bottom straw component
17 Lower bottom ridge edge
18 Holding frame anchor point/bottom straw component
19 Holding frame
20 Outside of aluminum lift tab container (can)
22 Adjustable outer segmented portion of top straw component
23 Uppermost portion of top component of straw
24A Straw system anchor point
24B Straw system anchor point
25 Lid opening
26 Lid opening access
27 Lid junction to container
28 Rolled lip of top straw component
29 Holding frame arm
30 Bottom straw component with angular cut

DETAILED DESCRIPTION OF THE PREFERRED EMBODIMENT

The all aluminum internal to external self-buoyant straw system invention depicted by reference numbers: 13, 14, 15, 16, 18, 19, 22, 23, 24A, 24B, 28, 29, 30 of the drawings.

Turning now descriptively to said drawings in which similar reference numbers denote similar elements throughout the several views. The figures illustrate an all aluminum fabricated internal to external self-buoyant straw system by itself and as an improvement for the safe and sanitary removal of beverage from aluminum can lift tab containers.

Accordingly the internal to external self-buoyant straw system completely fabricated of aluminum, hollow in nature, consisting of 19 a stationary holding frame and 29 holding frame arm each of which is a stabilizing mechanism. Each being connected at their uppermost end by an appropriate adhesive at points 24A and 24B respectively to the underside of the aluminum can container's lid. The holding frame's lowermost end is connected by an appropriate adhesive at point 18 to the bottom straw component 16. The bottom straw component's lowermost end 30 is angular cut at 45 degrees and is held in continuous contact with the innermost bottom of the aluminum can container, thereby allowing for complete removal of the container's contents. The straw guidance ring 13 is horizontally connected to 29 at its lowermost end and appropriately to 19, thereby being direct line with 26 the aluminum can container's lid access opening.

A two part straw including a top straw component 14 and a bottom straw component 16. The bottom straw component 16 extends into a lower end of the top straw component 14. The top straw component extends towards the top of the can and through the straw guidance ring 13. The straw guidance ring vertically guides the top straw component 14. A buoyancy float 15 is positioned around the top straw component 14 at a position between the straw guidance ring 13 and the bottom of the can. The buoyancy float 15 may be integrally fabricated with the top straw component 14. Being hollow in its fabrication top straw component 14 slides vertically upon 16 bottom straw component, which is also hollow. When the aluminum can beverage container is opened for consumption the top straw component 14 raises to the pre-determined height by its integral float component 15 coming in contact with the guidance ring 13 and stops. Thus 22 the adjustable outer segmented straw portion of the top straw component having cleared the container may be angular adjusted for ease of consumption. The uppermost portion 23 of the top straw component 14 has an outward rolled lip for added safety.

Reference numbers 2, 3, 10, 12, 17, 20, 25, 26, 27, of the drawings are not part of this specific invention and therefore not sought to be patented by this application. They generally depict relatively standard components of a lift tab aluminum can beverage container. To which the internal to external self-buoyant straw system was formated as an improvement thereunto.

The operation of the present claimed invention will now be discussed.

To activate the internal to external self-buoyant straw system the following steps should be followed:

1. Lift up 12 the tab so that it will tip downward to push 26 the lid access panel into the interior of the beverage container;
2. Press 12 the tab back down flat;
3. After the internal to external self-buoyant straw system's top straw component 14 has extended itself past 25 the lid opening bend 22 the adjustable out segmented portion of the straw so that the 28 rolled lip portion of the straw is at the desired angle to facilitate consumption of the container's contents;

While certain novel features of the internal to external self-buoyant straw system have been shown and described either in part or in full and pointed out in the annexed claims, it is not limited to those details, since it is understood that various omissions, modifications, substitutions and/or changes in the forms and details of the invention illustrated and in its operation can be made by those skilled in the art without departing in any way from the spirit of the present invention.

Without further analysis, the foregoing will so fully reveal the art of the internal to external self-buoyant straw system that others can by applying current knowledge, readily adapt it for various application without omitting features that from the standpoint of prior art, fairly constitute essential characteristics and the generic or specific aspects of this invention.

I claim:

1. A straw system for use in drinking contents within a can, said straw system comprising:

a) a holding frame positioned within the can and extending between a top and bottom side of an inside of the can;

b) a guidance ring connected to said holding frame and said holding frame includes a main bar extending between the top and bottom sides of the sides of the inside of the can and an arm extending from said main bar at a position along a length thereof and to the top side of the can, wherein said guidance ring is connected between said main bar and said arm;

c) a straw comprising a fixed bottom straw portion and a top straw portion;

d) said top straw portion slideably connected to said bottom straw portion and held in alignment with an opening in the can by said guidance ring; and e) a buoyancy float connected to said top straw portion, wherein upon opening a tab of the can, said buoyancy float causes said top straw portion to float to a position extending out of the can while said fixed bottom straw portion is restrained against movement thereby enabling the contents within the can to be readily and safely consumed and wherein said guidance ring limits a height to which said buoyancy float is able to rise within the can and thus limits a distance said top straw portion extends from the can.

2. The straw system as claimed in claim 1, wherein said top straw component is hollow and has a circumference slightly larger than a circumference of said bottom straw component, said bottom straw component extending into said top straw component.

3. The straw system as claimed in claim 1, wherein said top straw portion includes an adjustable portion allowing a user to bend the top straw portion to extend at a desired angle.

4. The straw system as claimed in claim 1, wherein said upper straw portion further includes a rolled end lip.

5. The straw system as claimed in claim 1, wherein a lower end of said bottom straw portion has an angular cut with a tip held in contact with the inner bottom side of the can by a lowermost portion of said holding frame engaged to said bottom straw portion above said angular cut using an adhesive thereby allowing for complete removal of contents of the can.

* * * * *